US008180084B2

(12) United States Patent
Higgins et al.

(10) Patent No.: US 8,180,084 B2
(45) Date of Patent: May 15, 2012

(54) INTEGRATED BATTERY DOOR AND SWITCH

(75) Inventors: Sidney A. Higgins, Maple Grove, MN (US); Brian Fideler, Jordan, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1383 days.

(21) Appl. No.: 11/689,354

(22) Filed: Mar. 21, 2007

(65) Prior Publication Data

US 2008/0232622 A1 Sep. 25, 2008

(51) Int. Cl.
*H04R 25/00* (2006.01)

(52) U.S. Cl. ..... 381/323; 381/324

(58) Field of Classification Search ..... 381/312, 381/322, 323, 324, 328, 329
See application file for complete search history.

(56) References Cited

U.S. PATENT DOCUMENTS

| | | | | |
|---|---|---|---|---|
| 3,701,862 | A | 10/1972 | Vigini | |
| 4,598,177 | A | 7/1986 | McGroarty et al. | |
| 4,634,815 | A | 1/1987 | Marquis | |
| 5,588,064 | A * | 12/1996 | McSwiggen et al. | 381/312 |
| 5,675,657 | A | 10/1997 | Giannetti | |
| 5,687,242 | A * | 11/1997 | Iburg | 381/312 |
| 5,742,692 | A | 4/1998 | Garcia et al. | |
| 5,799,095 | A | 8/1998 | Hanright | |
| 5,995,636 | A * | 11/1999 | Tøpholm | 381/323 |
| 6,088,465 | A | 7/2000 | Hanright et al. | |
| 6,144,749 | A | 11/2000 | Fideler | |
| 6,167,141 | A | 12/2000 | Yoest | |
| 6,324,291 | B1 | 11/2001 | Weidner | |
| 6,589,688 | B2 * | 7/2003 | Jørgensen et al. | 429/96 |
| 6,678,385 | B2 | 1/2004 | Olsen | |
| 6,731,770 | B1 | 5/2004 | Vonlanthen | |
| 6,829,363 | B2 | 12/2004 | Sacha | |
| 7,142,682 | B2 * | 11/2006 | Mullenborn et al. | 381/322 |
| 7,171,014 | B2 | 1/2007 | Morales et al. | |
| 7,221,769 | B1 * | 5/2007 | Jorgensen | 381/328 |
| 7,254,247 | B2 * | 8/2007 | Kragelund et al. | 381/322 |

FOREIGN PATENT DOCUMENTS

| | | |
|---|---|---|
| CH | 0667766 A | 10/1988 |
| EP | 704143 | 9/2000 |
| EP | 1082874 | 3/2001 |
| JP | 60261296 | 12/1985 |
| JP | 62008446 | 1/1987 |
| JP | 7203594 | 8/1995 |
| WO | WO-9956501 | 11/1999 |
| WO | WO-0225551 | 5/2000 |

OTHER PUBLICATIONS

"U.S. Appl. No. 10/284,878, Advisory Action mailed Aug. 25, 2005", 2 pgs.

(Continued)

*Primary Examiner* — Davetta W Goins
*Assistant Examiner* — Phylesha Dabney
(74) *Attorney, Agent, or Firm* — Schwegman, Lundberg & Woessner, P.A.

(57) ABSTRACT

The present subject matter includes a switch and an operator to interface with the switch, the operator in a battery door of a hearing assistance device. One embodiment includes a housing, hearing assistance electronics disposed in the housing, a hinge electrically connected to the hearing assistance electronics, and a battery door coupled to the hinge, the battery door includes a switch comprising an operator and at least one contact connected to the hinge.

26 Claims, 6 Drawing Sheets

OTHER PUBLICATIONS

"U.S. Appl. No. 10/284,878, Examiner Interview Summary filed Aug. 23, 2005", 3 pgs.
"U.S. Appl. No. 10/284,878, Examiner Interview Summary filed Nov. 18, 2005", 2 pgs.
"U.S. Appl. No. 10/284,878, Examiner Interview Summary mailed Oct. 24, 2005", 2 pgs.
"U.S. Appl. No. 10/284,878, Final Office Action mailed Apr. 6, 2006", 6 pgs.
"U.S. Appl. No. 10/284,878, Final Office Action mailed Apr. 22, 2005", 7 pgs.
"U.S. Appl. No. 10/284,878, Non-Final Office Action mailed Jul. 22, 2004", 7 pgs.
"U.S. Appl. No. 10/284,878, Notice of Allowance mailed Sep. 28, 2006", 4 pgs.
"U.S. Appl. No. 10/284,878, Response filed Jan. 20, 2006 to Restriction Requirement mailed Dec. 22, 2005", 8 pgs.
"U.S. Appl. No. 10/284,878, Response filed Jun. 13, 2005 to Final Office Action mailed Apr. 22, 2005", 9 pgs.
"U.S. Appl. No. 10/284,878, Response filed Jul. 6, 2006 to Final Office Action mailed Apr. 6, 2006", 9 pgs.
"U.S. Appl. No. 10/284,878, Response filed Oct. 22, 2004 to Non-Final Office Action mailed Jul. 22, 2004", 11 pgs.
"U.S. Appl. No. 10/284,878, Restriction Requirement mailed Dec. 22, 2005", 5 pgs.
"Canadian Application Serial No. 2,447,284, Office Action mailed Mar. 15, 2007", 3 pgs.
"Canadian Application Serial No. 2,447,284, Office Action mailed Oct. 31, 2007", 3 pgs.
"European Application Serial No. 03256911.3, European Search Report mailed Feb. 20, 2007", 4 pgs.
"European Application Serial No. 03256911.3, Office Action mailed Oct. 1, 2007", 5 pgs.
"European Application Serial No. 08251009.0, Extended European Search Report mailed Jul. 11, 2008", 7 pgs.
Schroeder, M., "Zinc Air Batteries—Here Today, Here Tomorrow", *Hearing Instruments*, 38(7), Harcourt Brace Jovanovich Publ. Duluth, Minnesota, US, (Jul. 1987), 11-12.
"Canadian Application Serial No. 2,447,284, Response filed Apr. 30, 2008 to Office Action mailed Oct. 31, 2007", 9 pgs.
"Canadian Application Serial No. 2,447,284, Response filed Sep. 11, 2007 to Office Action mailed Mar. 15, 2007", 9 pgs.
"European Application Serial No. 03256911.3, Office Action mailed Jan. 23, 2009", 2 pgs.
"European Application Serial No. 03256911.3, Response filed Jun. 1, 2009 to Office Action mailed Jan. 23, 2009", 20 pgs.
"European Application Serial No. 03256911.3, Response filed Jul. 30, 2008 to Office Action mailed Oct. 1, 2007", 31 pgs.
"European Application Serial No. 08251009.0, Office Action mailed Dec. 1, 2008", 2 pgs.
"European Application Serial No. 08251009.0, Response filed Mar. 16, 2009 to Office Action mailed Dec. 1, 2008", 10 pgs.
"European Application Serial No. 10004791.9, Extended Search Report mailed Mar. 1, 2012", 7 pgs.

* cited by examiner

INTEGRATED BATTERY DOOR AND SWITCH

TECHNICAL FIELD

This disclosure relates to devices which assist hearing, and more specifically to a battery door with an integrated switch for a hearing assistance devices.

BACKGROUND

The ability to adjust operational parameters of a hearing assistance device is a feature of the device that is both useful and desirable. For example, users have benefited from the ability to adjust the volume of a hearing assistance device.

Hearing assistance devices employ different types of switches to assist the user in making operational adjustments. Momentary switches are one type of switch commonly used on hearing assistance devices. However, momentary switches in small hearing assistance devices require costly and complex micro molded mechanical components. These components take up space within the housing of the hearing assistance device.

Thus, there is a need in the art for switches that provide economy in design, assembly, operation and space as to their use in hearing assistance devices.

SUMMARY

This application addresses the foregoing needs in the art and other needs not discussed herein. The various embodiments described herein relate to user controls incorporated into the battery door of a hearing assistance devices.

The present subject matter provides method and apparatus related to hearing assistance devices with at least one control disposed within a battery door. In one example, the control is electrically connected through the battery door hinge to hearing assistance electronics within the hearing assistance device housing. In various embodiments, the control includes an operator and a switch. In various examples, the battery door with an integrated control is provided for use with various hearing assistance device housings. Examples of connecting the switch to the electronics and providing for switch activation are provided in varying embodiments. The present subject matter also includes methods of using the battery door with an integrated control, for example, operating the control to adjust parameters affecting the operation of the hearing assistance electronics, such as volume.

This Summary is an overview of some of the teachings of the present application and not intended to be an exclusive or exhaustive treatment of the present subject matter. Further details about the present subject matter are found in the detailed description and appended claims.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1A:
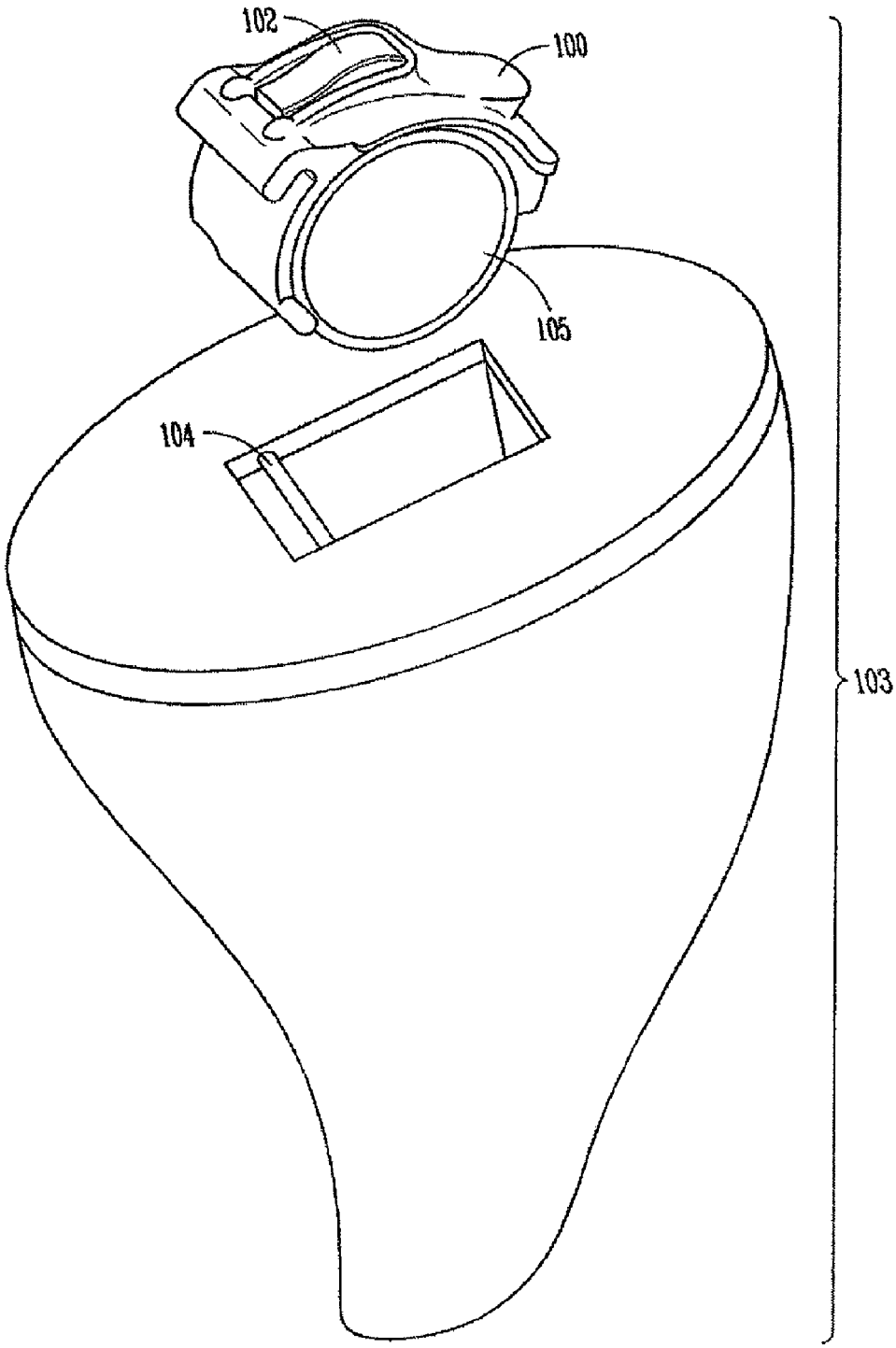
FIG. 1A illustrates an example of the battery door in use with a in-the-ear (ITE) type housing.

FIG. 1A shows a three dimensional example of one embodiment of the battery door 100 according to the present subject matter. The battery door 100 incorporates a switch 102 for assisting the user in modifying the operation of a hearing assistance device 103. When the battery door 100 is properly installed in the hearing assistance device 103, the switch 102 is electrically connected to the electronics of the hearing assistance device through a pre-wired hinge pin 104. The battery door 100 is configured to make connections between the electronics of the hearing assistance device and the battery 105 when in a closed state.

Figure 1B:
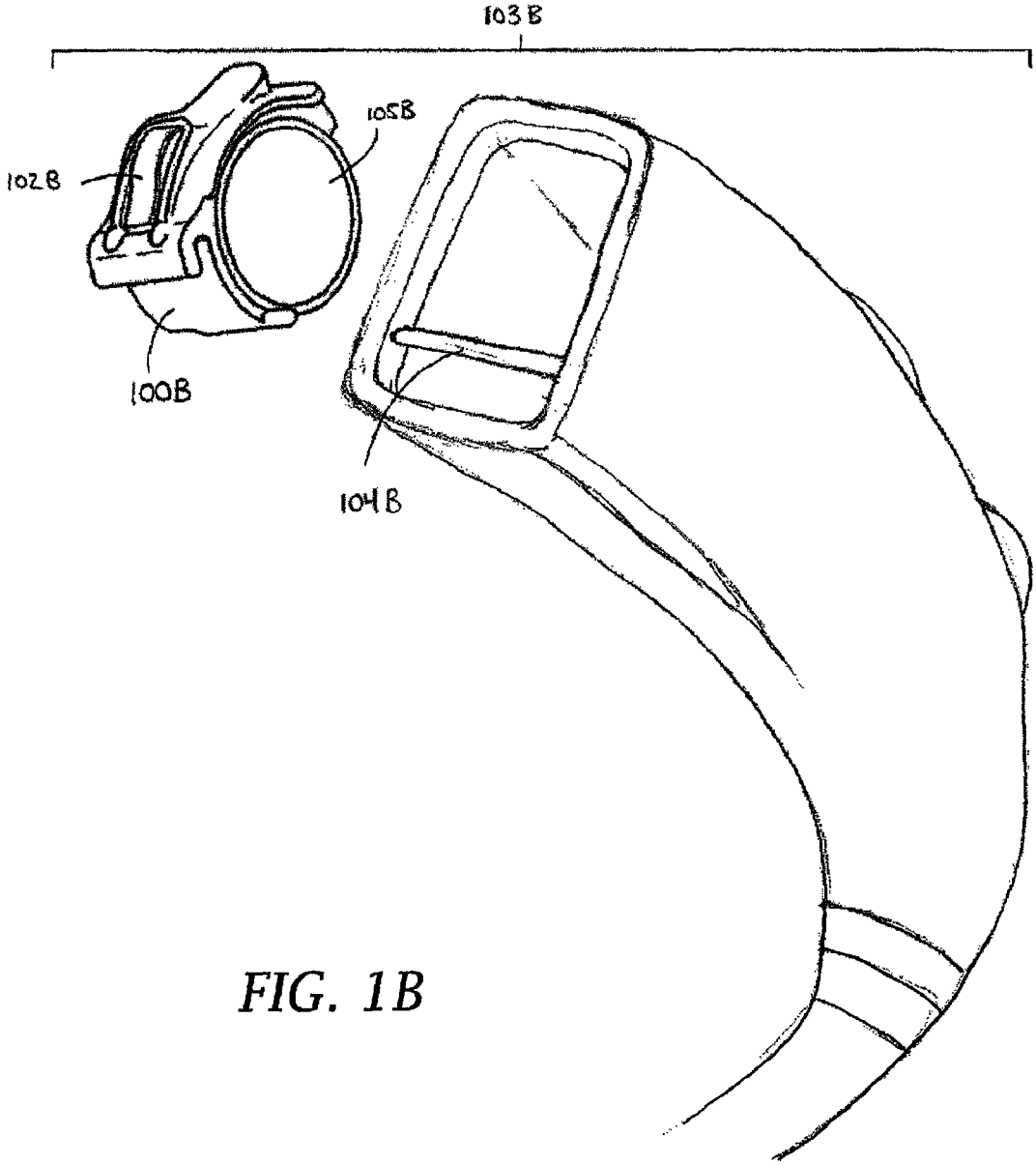
FIG. 1B illustrates an example of the battery door in use with a behind-the-ear (BTE) type housing.
Figure 1C:
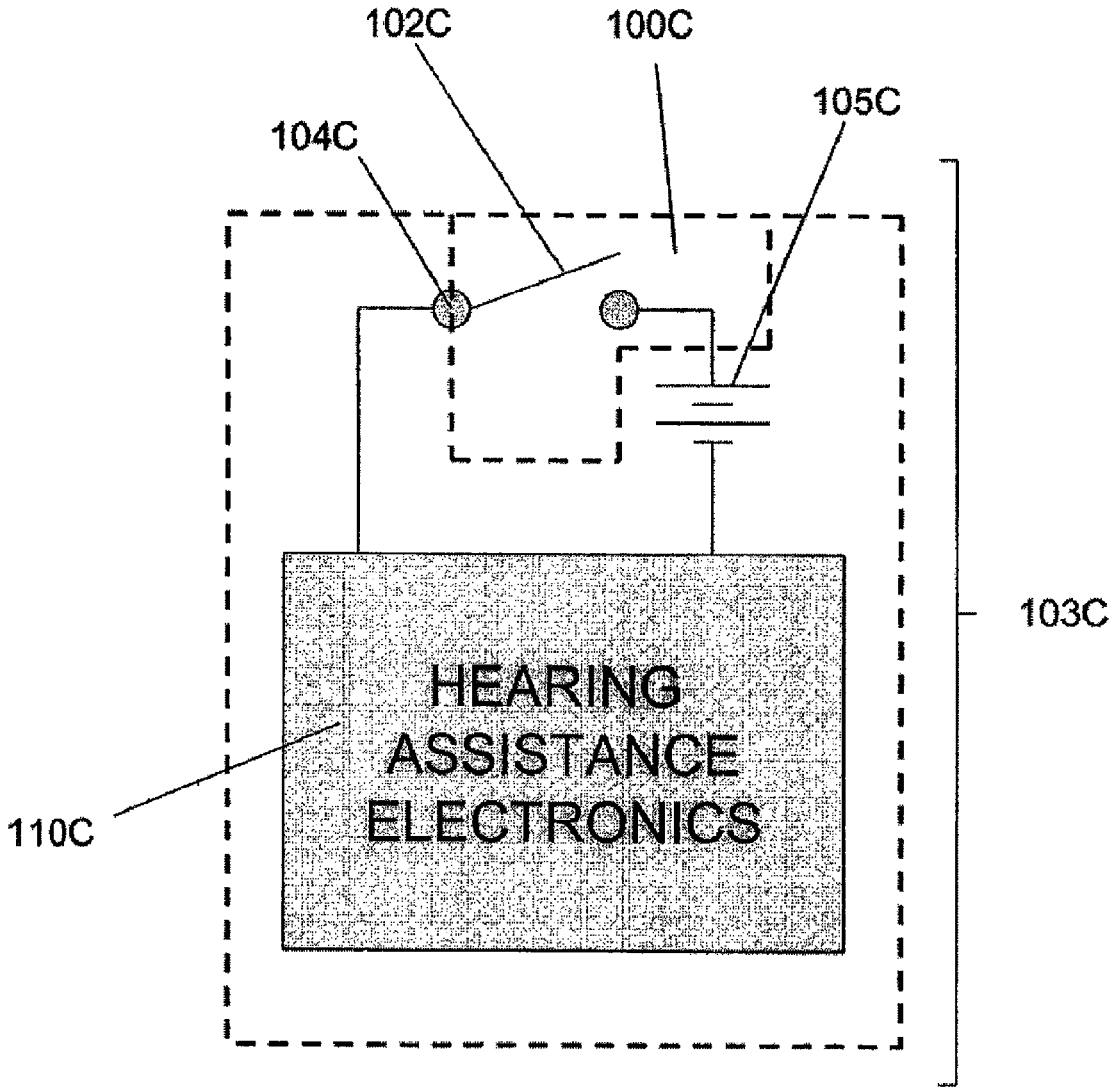
FIG. 1C illustrates the equivalent circuit diagram of a battery door with an integrated switch according to various embodiments.

FIG. 1A illustrates an embodiment of the battery door 100 adapted for use with an in-the-ear (ITE) type hearing assistance device 103. FIG. 1B shows an embodiment of the battery door 100B adapted for use with a behind-the-ear (BTE) type hearing assistance device 103B. The embodiment of FIG. 1B includes an integrated switch 102B, a battery 105B and a pre-wired hinge pin 104B. Various embodiments of the present subject matter are adapted for use with over-the-ear (OTE) and receiver-in-canal (RIC) housings. FIG. 1C illustrates the equivalent circuit diagram of a battery door with an integrated switch according to various embodiments. FIG. 1C includes a hearing assistance device 103C, a battery door 100C with an integrated switch 102C, a battery 105C and hearing assistance electronics 110C. The integrated switch 102C forms part of a circuit connected to the hearing assistance device 110C. Generally, the illustrated circuit includes the battery 105C and switch 102C, wherein the switch includes a conductive hinge member 104C pre-wired to the hearing assistance electronics 110C.

Figure 2:
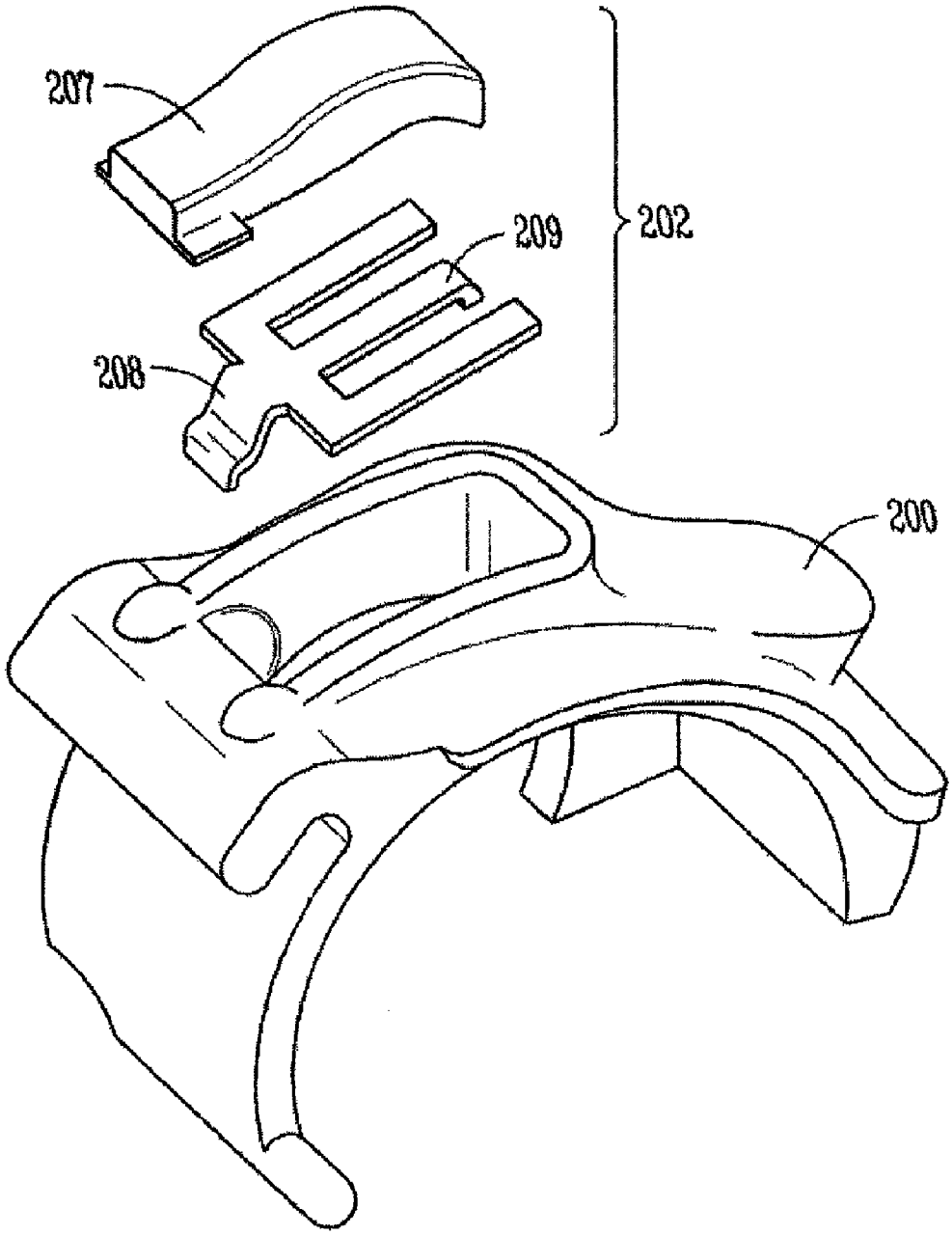
FIG. 2 shows an exploded view of a integrated momentary switch according to the present subject matter.

FIG. 2 shows a three dimensional exploded view of an integrated switch 202 according to one embodiment of the present subject matter. The switch 102 includes an operator 207, in the form of a button and a spring member 208. The illustrated spring member 208 includes three tabs. The center tab 209 is made from electrically conductive material and forms a contact of the switch 202. The two outside tabs of the spring member are insert molded into the battery door 200. The switch 202 is assemble by snapping the operator 207 into the opening of the battery door 200 such that the spring member 208 is between the operator 207 and a subsequently installed battery. In various embodiments, operator 207 and battery door 200 are made of nonconductive material, for example, injection molded plastic. In various embodiments, the operator is in a form other than a button. For example, the operator may be a slide bar, a rotary operator, a toggle or other operator form. These switch operators allow switch functionality to be maintained or momentary, as well as, normally opened or normally closed.

Figure 3:
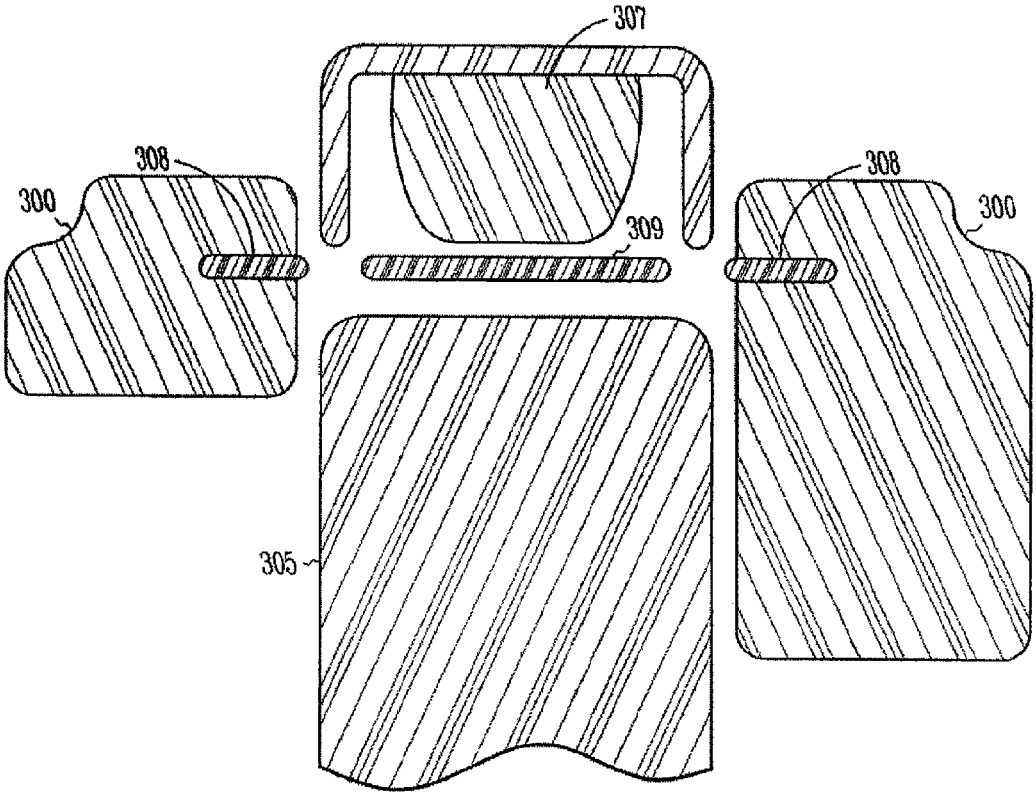
FIG. 3 illustrates a cutaway view of an assembled battery door with the spring member insert molded into the battery door.

FIG. 3 illustrates a cutaway view of an assembled battery door 300 with the spring member 308 insert molded into the battery door 300. In the illustrated example, pressure applied to the operator 307, in the direction of the battery 305, causes the center tab 309 of the spring member 308 to contact the battery 305.

Figure 4:
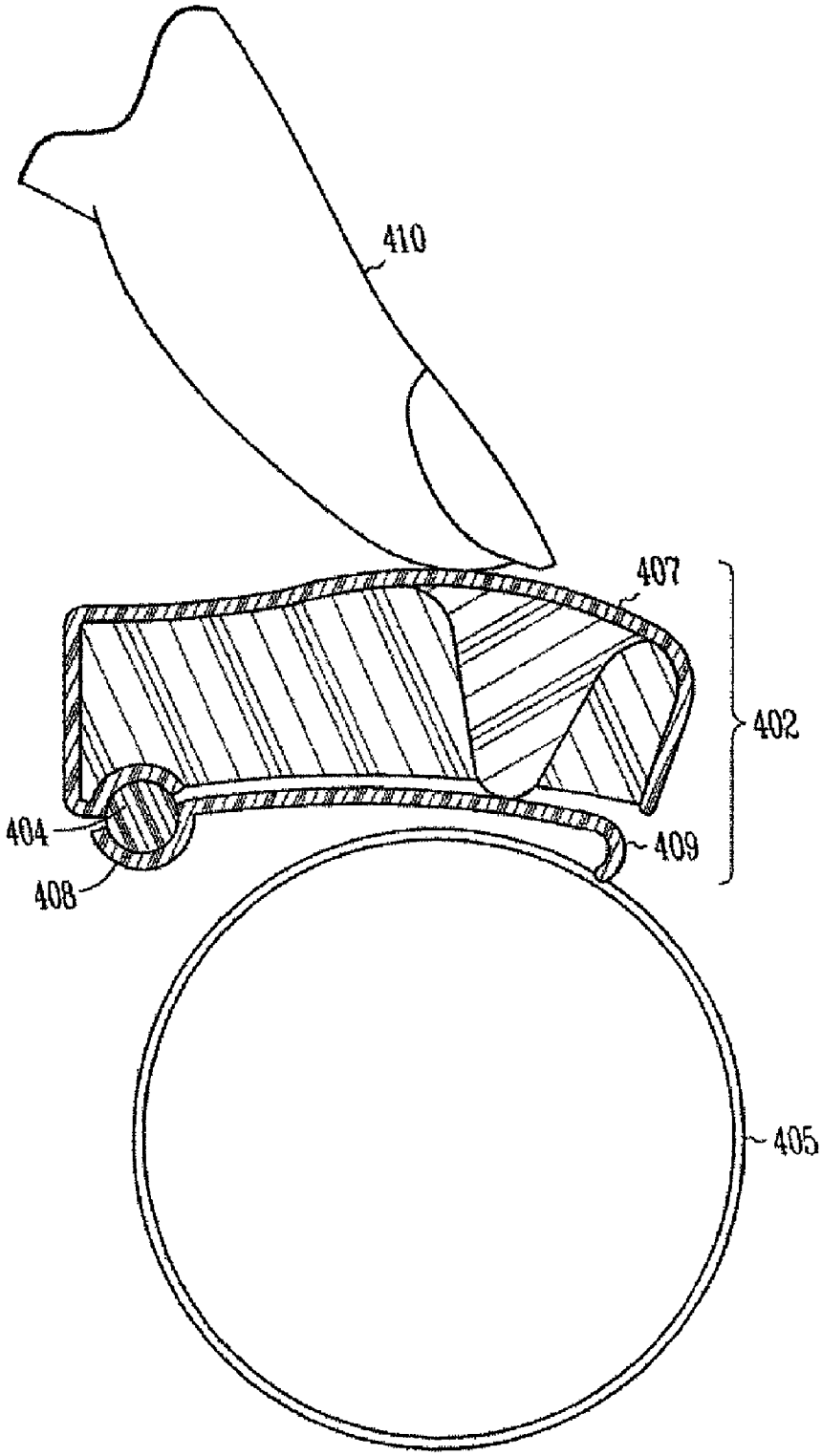
FIG. 4 is a cross-section of a portion of an assembled battery door installed in a hearing assistance device.

FIG. 4 is a cross-section of a portion of the assembled battery door installed in a hearing assistance device. FIG. 4 includes the operator 407, the contact portion 409 of spring member 408, the battery 405 and the hinge pin 404. The illustration shows a user 410 operating the momentary switch 402 such that the switch contact 409 closes on the battery 405 completing a circuit connected to the hearing assistance electronics. The pressure exerted on the operator 407 deforms the spring member 408 such that the contact tab 409 of the spring member contacts the battery 405. Upon contact with the battery 405, the switch 402 completes a circuit. In various embodiments, the circuit includes the hearing assistance electronics connected to the battery 405, the battery connected to the contact tab 409 of the spring member 408, and the spring member 408 in contact with the hinge pin 404, the hinge pin being pre-wired to the hearing assistance electronics. Upon the user 410 releasing pressure from the switch 402, the spring member 408 returns to an unbiased state such that the contact tab 409 withdraws from the battery 405.

The present subject matter extends to various hearing aid designs including, but not limited to, in-the-ear, in-the-canal, completely-in-the-canal and behind-the-ear designs. The present subject matter provides an economical, reliable and robust solution to providing a switch in a battery door of a hearing assistance device.

This description has set forth numerous details and features of various embodiments, but is intended to be illustrative and not intended in an exclusive or exhaustive sense. Changes in detail, material, parts, order of process and design may occur without departing from the scope of the appended claims and their legal equivalents.

What is claimed is:

1. An apparatus for an ear of a user, comprising:
a housing;
hearing assistance electronics disposed in the housing;
a battery at least partially disposed in the housing, the battery in electrical communication with the hearing assistance electronics:
a hinge pin electrically connected to the hearing assistance electronics;
a battery door for removably enclosing the battery at least part of the way into the housing, and coupled to the hinge pin; and
a switch electrically connected to the hearing assistance electronics using the conductive hinge pin, the switch disposed in the battery door.

2. The apparatus of claim 1, wherein the housing is a completely-in-the-canal housing.

3. The apparatus of claim 1, wherein the housing is an in-the-canal housing.

4. The apparatus of claim 1, wherein the housing is a behind-the ear housing.

5. The apparatus of claim 1, wherein the housing is an in-the-ear housing.

6. The apparatus of claim 1, wherein the button is adapted to adjust volume.

7. The apparatus of claim 1, wherein the switch includes a spring, the spring adapted to effect a mechanical bias on the operator away from the battery and forms at least a portion of a circuit including the hearing assistance electronics, the hinge pin, and the contact when a force upon the operator overcomes the mechanical bias.

8. The apparatus of claim 7, wherein the contact forms a portion of the spring.

9. The apparatus of claim 7, wherein the operator includes at least one nonconductive material, and the spring includes at least one conductive material.

10. The apparatus of claim 9, wherein the spring is at least partially insert molded into the battery door.

11. The apparatus of claim 7, wherein the spring includes a cantilever spring.

12. The apparatus of claim 7, wherein the switch is a momentary switch.

13. The apparatus of claim 1, wherein the hinge pin includes a metal hinge pin.

14. The apparatus of claim 13, wherein the battery door is removably clipped to the hinge pin.

15. An apparatus for an ear of a user, comprising:
a housing;
hearing assistance electronics disposed in the housing;
a battery at least partially disposed in the housing, the battery in electrical communication with the hearing assistance electronics;
battery door means for removably enclosing the battery at least part of the way into the housing, and coupled to a conductive hinge pin; and
switch means electrically connected to the hearing assistance electronics using the conductive hinge pin, the switch means disposed in the battery door means.

16. The apparatus of claim 15, further comprising spring means for holding the switch means against the battery door and away from the battery unless a mechanical bias pushes the switch means toward the battery, the spring means including means to form a circuit, the circuit including the hearing assistance electronics, the battery door means, the spring means, and the battery upon introduction of a mechanical bias sufficient to push the spring means into contact with the battery.

17. The apparatus of claim 16, wherein the button means include a plastic button cover sandwiched between the spring means and the battery door.

18. The apparatus of claim 17, wherein the battery door means retains a button cell battery.

19. The apparatus of claim 18, wherein the spring means is adapted to contact a surface of the button cell.

20. The apparatus of claim 15, further comprising:
a hinge electrically connected to the hearing assistance electronics;
wherein the switch means comprises an operator and at least one contact electrically connected to the hinge,
wherein the switch means includes a spring, the spring adapted to effect a mechanical bias on the operator away from the battery and forms at least a portion of a circuit including the hearing assistance electronics, the hinge, and the contact when a force upon the operator overcomes the mechanical bias, and wherein the spring includes a cantilever spring.

21. The apparatus of claim 15 further, comprising:
a hinge electrically connected to the hearing assistance electronics;
wherein the switch means comprises an operator and at least one contact electrically connected to the hinge,
wherein the switch means includes a spring, the spring adapted to effect a mechanical bias on the operator away from the battery and forms at least a portion of a circuit including the hearing assistance electronics, the hinge, and the contact when a force upon the operator overcomes the mechanical bias, and wherein the switch is a momentary switch.

22. A method, comprising:

providing a hearing assistance device for an ear of a user, the device including:

a housing;

hearing assistance electronics disposed in the housing:

a battery at least partially disposed in the housing, the battery in electrical communication with the hearing assistance electronics:

battery door means for removably enclosing the battery at least part of the way into the housing, and coupled to a conductive hinge pin; and switch means electrically connected to the hearing assistance electronics using the conductive hinge pin, the switch means disposed in the battery door means; and selecting an operative mode of the hearing assistance device by operating the switch means.

23. The method of claim 22, wherein selecting an operative mode of the hearing assistance device includes selecting a preset volume level of the hearing assistance device by operating the switch means.

24. An apparatus for an ear of a user, comprising:

a housing;

hearing assistance electronics disposed in the housing;

a battery at least partially disposed in the housing, the battery in electrical communication with the hearing assistance electronics;

battery door means for removably enclosing the battery at least part of the way into the housing, and coupled to a hinge pin;

switch means electrically connected to the hearing assistance electronics using the hinge pin, the switch means disposed in the battery, door means; and spring means for holding the switch means against the battery door and away from the battery unless a mechanical bias pushes the switch means toward the battery, the spring means including means to form a circuit, the circuit including the hearing assistance electronics, the battery door means, the spring means, and the battery upon introduction of a mechanical bias sufficient to push the spring means into contact with the battery, wherein the button means include a plastic button cover sandwiched between the spring means and the battery door.

25. The apparatus of claim 24, wherein the battery door means retains a button cell battery.

26. The apparatus of claim 25, wherein the spring means is adapted to contact a surface of the button cell.

* * * * *

UNITED STATES PATENT AND TRADEMARK OFFICE

CERTIFICATE OF CORRECTION

PATENT NO. : 8,180,084 B2
APPLICATION NO. : 11/689354
DATED : May 15, 2012
INVENTOR(S) : Higgins et al.

It is certified that error appears in the above-identified patent and that said Letters Patent is hereby corrected as shown below:

On Title page 1, in column 2, under "Foreign Patent Documents", line 8, delete "WO-0225551" and insert --WO-20025551--, therefor In The Claims In column 4, line 60, in claim 21, delete "15 further," and insert --15, further--, therefor Signed and Sealed this
Eighteenth Day of November, 2014

Michelle K. Lee

Michelle K. Lee
*Deputy Director of the United States Patent and Trademark Office*